United States Patent [19]

Sintron

[11] 4,030,242

[45] June 21, 1977

[54] HOOP AND PROPELLED MEANS

[76] Inventor: Cruz Sintron, 279 N. Broadway, Yonkers, N.Y. 10701

[22] Filed: May 21, 1976

[21] Appl. No.: 688,598

[52] U.S. Cl. ..... 46/220; 273/129 A

[51] Int. Cl.[2] ..... A63H 33/02

[58] Field of Search ..... 46/114, 220; 124/5; 273/129 A

[56] References Cited

UNITED STATES PATENTS

| | | | |
|---|---|---|---|
| 1,164,609 | 12/1915 | Darton | 124/5 |
| 3,708,911 | 1/1973 | Haschek | 46/220 |

*Primary Examiner*—Louis G. Mancene
*Assistant Examiner*—Robert F. Cutting
*Attorney, Agent, or Firm*—Robert D. Farkas

[57] ABSTRACT

This disclosure pertains to a circular hoop having an outermost annular opening containing a pair of inwardly turned edges for snap-in engagement with a spherical shape that is fastened to one end of a hand held hoop propelling rod. An innermost notch, having a semi-circular cross-section having a mouth portion thereof directed towards the central axis of the hoop, is adapted to receive the spherical shape in frictional engagement therein.

6 Claims, 3 Drawing Figures

HOOP AND PROPELLED MEANS

BACKGROUND OF THE INVENTION

1. The Field of the Invention

This invention relates to game apparatus and more specifically to that class utilizing hoops and hoop propelling devices.

2. Description of the Prior Art

The prior art abounds with hoops and hoop propelling devices. U.S. Pat. No. 2,562,522 issued on July 31, 1951 to C. P. Boyd teaches a pair of roller-like devices in spaced apart relationship fastened to one end of a rod. A pair of plates interconnecting the ends of the rolling devices and the rolling devices, form an opening through which a circular hoop, having a circular cross-section is captured. The hoop and the propelling device are joined together thereby eliminating the hazard of children chasing a hoop that has escaped from their immediate vicinity.

U.S. Pat. No. 3,001,325 issued on Sept. 26, 1961 to J. M. Riccobono et al discloses a convoluted termination at one end of a hoop rolling and guiding device adapted to control a circular hoop having a circular cross-section, in various states of rolling motion.

U.S. Pat. No. 3,464,149 issued on Sept. 2, 1969 to L. R. Batterson et al teaches a control device for a hoop having an elongated control rod having one end which is used to rotatably drive the hoop in a substantially upright longitudinally aligned attitude with respect to the control rod when a pushing force is exerted on the control rod so as to propel the hoop in a forward direction.

All of the aforementioned patents suffer the common deficiency of engaging a hoop with propelling or manipulative forces of similar character when applied to the outermost or innermost surfaces of a circular hoop, having a circular cross-section. Thus, the hoop activity is restricted to rolling or propelling the hoop in a captured or free state, utilizing a propelling implement.

SUMMARY OF THE INVENTION

A primary object of the present invention is to provide a hoop and propelling device which enables the user to selectively capture the hoop for stopping purposes or in preparation to either propel or throw the hoop, utilizing a rod-like propelling device.

Another object of the present invention is to provide a hoop and propelling device which enables the user to frictionally engage a portion of the hoop's surface, without snapingly capturing the propelling device.

Still another object of the present invention is to provide a hoop and propelling device which may be tossed into the air, utilizing the propelling device and caught upon one free end of the propelling device by engaging the innermost and outermost edges of the hoop.

Yet another object of the present invention is to provide a hoop whose outermost marginal edges contact a supporting surface at two points thereby insuring greater stability while supporting the hoop.

Heretofore, hoop propelling devices in the main, contacted portions of the surface of the hoop so as to provide propelling and braking forces to the hoop. The instant invention provides the additional features of allowing the hoop to be propelled by contacting the outermost surface of the hoop, with moderate forces applied by the propelling device, in conventional fashion. When the forces applied are markedly increased, the hoop may be forced to stop rolling or may be captured by the propelling device preparatory to the hoop being tossed or propelled away from the propelling device with substantial tangential force applied to the outermost peripheral aspect of the hoop surface. Additionally, the interior curvature of the interior marginal edges of the hoop are designed to frictionally accommodate the distal end of the propelling device. Thus the hoop may be caught in mid-air by the propelling device, or, if desired, propelled away from the user, by engaging the distal end of the propelling device with the interior portion of the hoop at the far side thereof relative to the user. The utility and amusement value of the apparatus is thus vastly enhanced.

These objects, as well as other objects of the present invention, will become more readily apparent after reading the following description of the accompanying drawings.

DESCRIPTION OF THE PREFERRED EMBODIMENT

The structure and method of fabrication of the preferred embodiment is applicable to a propelling device comprising an elongated rod terminated at one end and with a spherically shaped object fixedly secured thereto. The other end of the rod, constituting the propelling device, is destined to be grasped by a hand of the user. The hoop portion, having a generally circular annular shape, is preferably fabricated from a metallic material. A cross-section of the hoop contains an innermost U shaped section, whose mouth portion is projecting radially inwardly towards the origin of the hoop. The remaining portions of the cross-section comprises a similarly U shaped cross-section, whose mouth portion is directed radially outwardly from the center of the hoop, having the free marginal edges thereof, adjacent the mouth portion, turned inwardly towards each other and further inwardly towards the origin of the hoop. Thus, the spherically shaped terminal end of the propelling device may be captured by the inwardly turned marginal edges of the hoop, in a snap-in, snap-out fashion, when the force applied to the spherically shaped end is sufficient to force the sphere radially inwardly past the inwardly turned edges. The spherically shaped termination may frictionally engage the U shaped cross-section located at the inner aspect of the surface of the hoop.

The rod may be fabricated from a plastic material or from glass filaments so as to possess a degree of flexibility along the longitudinal axis thereof, thereby facilitating the user's ability to "cast" the hoop or to catch the hoop on a resilient rod-like element, further increasing the amusement value of the apparatus.

Figure 1:
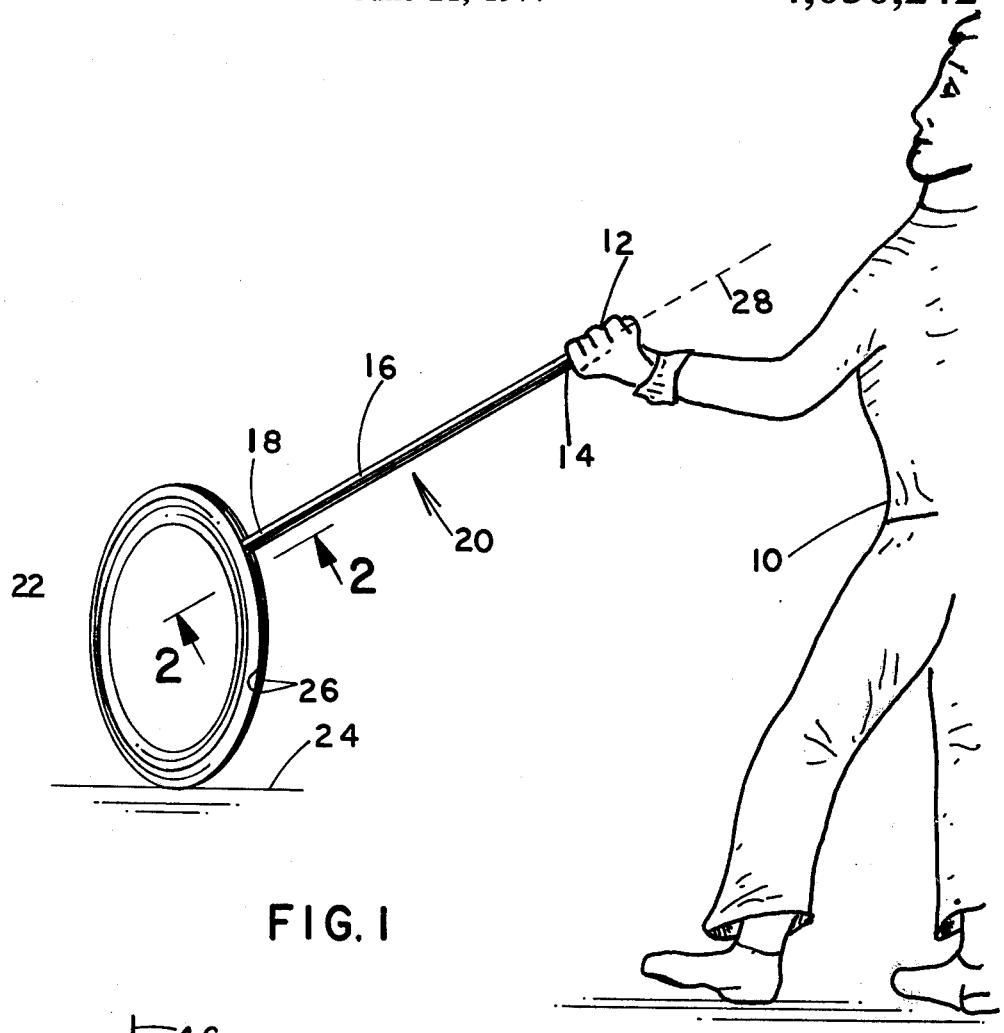
FIG. 1 is a perspective view of the instant invention shown being propelled by a user thereof.

Now referring to the FIGS., and more particularly to the embodiment illustrated in FIG. 1 showing a user 10 whose hand 12 is shown grasping the proximal end 14 of road 16. The distal end 18 of the propelling device 20 is in touching engagement with hoop 22, shown resting upon supporting surface 24. The outermost edges 26 of the hoop contact surface 24 at two points. Rod 16 possesses flexible characteristics along the direction of dotted line 28.

Figure 2:
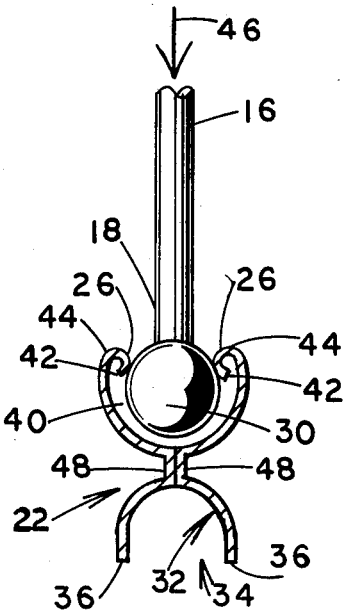
FIG. 2 is a cross-sectional view taken along line 2—2 viewed in the direction of arrows 2—2 as shown in FIG. 1 illustrating a portion of the propelling device engaged within a cross-section of the hoop.

FIG. 2 shows rod 16 equipped with a sphere 30 fixedly secured thereto at distal end 18. Hoop 22 has an innermost U shaped cross-section 32, including a mouth-like opening 34 and a pair of marginal edges 36, inwardly directed towards the origin of the hoop denoted by point 38. Sphere 30 is shown captured within void 40 formed by the outermost marginal edges 42, of the hoop, which are inwardly turned so as to form a pair of rolled-like sphere grasping edges 44. Moderate forces applied to rod 16, in the direction of arrow 46, will not overcome the position naturally assumed by rolled-like edges 44. When sufficient force is applied to rod 16, in the direction of arrow 46, rolled-like edges 44 are displaced outwardly allowing sphere 30 to successfully enter cavity 40. Points 26 appear at the outermost portions of rolled-like edges 44, as shown in FIG. 1.

The diameter of sphere 30 is sized to be somewhat smaller than the mouth opening 34, so as to permit sphere 30 to frictionally engage the innermost surface of U shaped cross-section 32 when desired. Ribs 48 join the opposing generally U shaped cross-sectional elements and lie in a plane parallel to the planes formed by edges 42.

Figure 3:
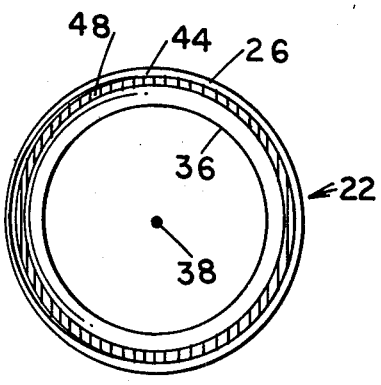
FIG. 3 is a side elevation view of the hoop.

FIG. 3 illustrates point 38 at the origin of hoop 22 and edges 36 being disposed intermediate point 38 and rolled-like edge 44. Rib 48 extends in annular fashion between edge 36 and rolled-like edge 44.

One of the advantages of the present invention is a hoop and propelling device which enables the user to selectively capture the hoop for stopping purposes or in preparation to either propel or throw the hoop, utilizing a rod-like propelling device. Another advantage of the present invention is a hoop and propelling device which enables the user to frictionally engage a portion of the hoop's surface, without snapingly capturing the propelling device.

Still another advantage of the present invention is a hoop which may be tossed into the air, utilizing the propelling device and caught upon one free end of the propelling device by engaging the innermost and outermost edges of the hoop.

Yet another advantage of the present invention is a hoop whose outermost marginal edges contact a supporting surface at two points thereby insuring greater stability while supporting the hoop.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. A hoop and propelling means comprising a propelling device, said propelling device having an elongated rod-like shape, a circular hoop, one end of said propelling device for manual grasping by the user, the other end of said propelling device for selective engagement with the exterior surfaces of said hoop, snap-like engagement means for capturing said other end of said propelling device along a first annular mouth passing through said exterior surfaces of said hoop, frictional engagement means for frictionally engaging said other end of said propelling device along a second annular mouth passing through said exterior surfaces of said hoop.

2. The hoop and propelling means as claimed in claim 1 wherein said propelling device comprises a semi-rigid material, said semi-rigid material possessing flexibility along the longitudinal axis of said elongated rod-like shape.

3. The hoop and propelling means as claimed in claim 1 wherein said snap-like engagement means comprises said first annular mouth being disposed adjacent to the outermost radial periphery of said hoop, said first annular mouth having a first opening confined within a first pair of marginal edges, said first pair of marginal edges turned inwardly towards the origin of said hoop, a sphere, said sphere being fixedly secured to said other end of said propelling device, the width of said first opening being smaller than the diameter of said sphere, said width increasing to said diameter of said sphere when said sphere is forcibly thrusted inwardly toward said origin or forcibly radially outwardly withdrawn in a direction away therefrom.

4. The hoop and propelling means as claimed in claim 3 wherein said frictional engagement means comprises said second annular mouth being disposed adjacent to the innermost radial surface of said hoop, said annular mouth having a second opening confined within a second pair of marginal edges, said second pair of marginal edges directed inwardly and lying in a pair of parallel planes, the width of said second opening being larger than said diameter of said sphere.

5. The hoop and propelling means as claimed in claim 3 wherein said first pair of marginal edges are disposed radially outwardly from the interior surfaces of a first cavity bounded thereby, said first cavity having a cross-sectional shape of sufficient size to freely accommodate said sphere.

6. The hoop and propelling means as claimed in claim 4 wherein said second pair of marginal edges are disposed radially outwardly from the interior surfaces of a second cavity bounded thereby, said second cavity having a semi-circular cross-sectional shape, said semi-circular cross-sectional shape of sufficient size to freely accommodate a portion of said sphere.

* * * * *